United States Patent [19]

Speich

[11] Patent Number: 4,913,195

[45] Date of Patent: Apr. 3, 1990

[54] GRIPPER LOOM

[75] Inventor: Francisco Speich, Gipf-Oberfrick, Switzerland

[73] Assignee: Textilma AG, Hergiswil, Switzerland

[21] Appl. No.: 254,369

[22] Filed: Oct. 5, 1988

[30] Foreign Application Priority Data

Oct. 6, 1987 [CH] Switzerland ..... 03906/87

[51] Int. Cl.[4] ..... D03D 47/34

[52] U.S. Cl. ..... 139/446; 139/450; 139/453

[58] Field of Search ..... 139/302, 429, 450, 453, 139/444, 446, 194, 370.2

[56] References Cited

U.S. PATENT DOCUMENTS 3,380,482 4/1968 Scherillo ..... 139/450
4,540,028 9/1985 Gehring et al. ..... 139/453
4,702,284 10/1987 Gehring ..... 139/446

FOREIGN PATENT DOCUMENTS 0119122 9/1984 European Pat. Off. ..... 139/450
3042053 11/1982 Fed. Rep. of Germany ..... 139/453

*Primary Examiner*—Henry S. Jaudon
*Attorney, Agent, or Firm*—Toren, McGeady & Associates

[57] ABSTRACT

A filling thread feeding device (2) comprises a thread guide (4) for placing at least one filling thread ($S_1$) into the entrainment region of a gripper (6) which can be extended into and retracted out of a shed (8). A pair of scissors (22) open against a weaving reed (14) is incorporated at the insertion side externally of the fabric edge (20) in the region of a looping edge (16). The scissors serve for cutting off a previously inserted filling thread ($S_1$, $S_2$, $S_3$, $S_4$) during renewed insertion into the shed (8). The scissors (22) are designed and arranged in order to improve the operational security and achieve a simpler construction of the gripper loom. The scissors are, on the one hand, closed during the looping motion of the weaving reed and, on the other hand, an inserted filling thread ($S_1$) can be conducted above and past the upper scissor blade (24) into a catching hook (32) lying in front (FIG. 2).

12 Claims, 4 Drawing Sheets

GRIPPER LOOM

FIELD AND BACKGROUND OF THE INVENTION

The present invention relates in general to weaving equipment and, in particular, to a new and useful gripper loom having a pair of scissors positioned to operate in conjunction with a weaving reed to position and cut filling threads of a fabric being woven.

Gripper looms of the type mentioned are known, for instance, from German DE-OS No. 25 34 494. A disadvantage of this type of gripper loom is that the upper scissor blade is designed as a bracket overlapping the lower scissor blade with an interspace, wherein the filling threads clinging to the edge of the fabric have to be conducted through the opening between the blade elements. The filling thread which is to be newly introduced into the shed is presented by the filling thread feeding device to the gripper. Herein, the gripper pulls the filling thread still fastened to the fabric edge, over the lower scissor blade into a clamping member assigned to the scissor blade, whereupon, the scissors are actuated and the filling thread is severed so that the new filling thread can be pulled into the shed. The residual filling thread remains clamped in the clamping member in order to prevent entanglement with filling threads remaining at the fabric edge. Apart from the fact that a pair of scissors designed in this manner is relatively complicated, the filling thread introduced into the weaving shed must be conducted in between the two scissor blades when it is looped by the weaving reed, wherein there arises the danger that such a filling thread is clamped in the clamping member. Clamping of the newly, to be introduced, filling thread in the clamping member involves difficulties since relatively high forces are required for this purpose which impair the filling insertions in such a way that the filling thread is pulled with too great a tension.

SUMMARY OF THE INVENTION

It is the task of the present invention to further improve the gripper loom of the previously mentioned type.

Accordingly, an object of the present invention is to provide a gripper loom which comprises filling thread feeding means for placing at least one filling thread into the entrainment region of a gripper, a gripper having an entrainment region for receiving a filling thread and being movable into and out of a shed formed by warp threads, a weaving reed movable between the warp threads in the shed for looping threads, a pair of scissors openable toward the weaving reed and arranged at an insertion side of the shed external of a fabric edge made up of woven filling and warp threads, in the region of a fell for cutting off a previously inserted and looped filling thread during a renewed insertion into the shed, the scissors being closed during the beat-up movement of the weaving reed so that an inserted filling thread is conducted above the scissors into a catch hook located in front of the scissors toward the weaving reed.

Because the scissors are closed during the beat-up motion of the weaving reed, the inserted filling thread certainly cannot penetrate in between the blades of the scissors and is securely inserted over the upper scissor blade into a catching or tucking hook located in front. On the one hand, this results in a simplification of the device and, on the other hand, in a gain of operational security, since an unwanted insertion of the filling thread in between the scissor blades is certainly avoided while looping the filling thread.

Further refinements are provided for the scissors for improving the operation of the gripper loom.

Particularly if the filling thread feeding device is equipped with a filling thread changer, the invention provides an additional refinement in order to securely orient the filling threads still remaining at the edge of the fabric with respect to the filling thread feeding device so that an equally secure advance of a filling thread into the entrainment region of the gripper is assured. A particularly good positional fixation is obtained especially with a fork-shaped embodiment. An embodiment of the invention is also advantageous if only one type of filling thread is to be introduced into the fabric.

The catch hook is advantageously positioned at the side of an upper blade of the scissors facing toward the weaving reed. Alternatively, the catch hook may be provided on the lower blade of the scissors.

Since the scissors are only required for cutting and one does not have to worry about leading a filling thread through them, the scissors can be designed so that they can operate in an optimum fashion. One of the scissor blades, in particular the upper blade, has a free end with a retaining lug pointing toward the other scissor blade to catch a filling thread. This is advantageous since the restraining nose prevent the filling thread from slipping out of the scissors during a cutting operation. Furthermore, it is appropriate if the upper and/or lower scissor blade are driven.

The filling thread feeding means has apparatus for submitting different filling threads to the gripper. The gripper loom is thus especially suited for filling thread feeding devices with a filling thread changer. A particularly simple device for deviation of the cutoff thread ends and thus for prevention of entanglement with filling threads still remaining at the edge of the fabric results from an embodiment, wherein a suction nozzle for receiving the severed ends of the filling threads is arranged near the scissors. The suction nozzle has the additional advantage in that it removes dust and fluff and thus permits a particularly clean operation. The suction nozzle is advantageously arranged so that it is between the scissors and the guiding element for other filling threads.

A further object of the present invention is to provide a gripper loom which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DESCRIPTION OF THE PREFERRED EMBODIMENT

Figure 1:
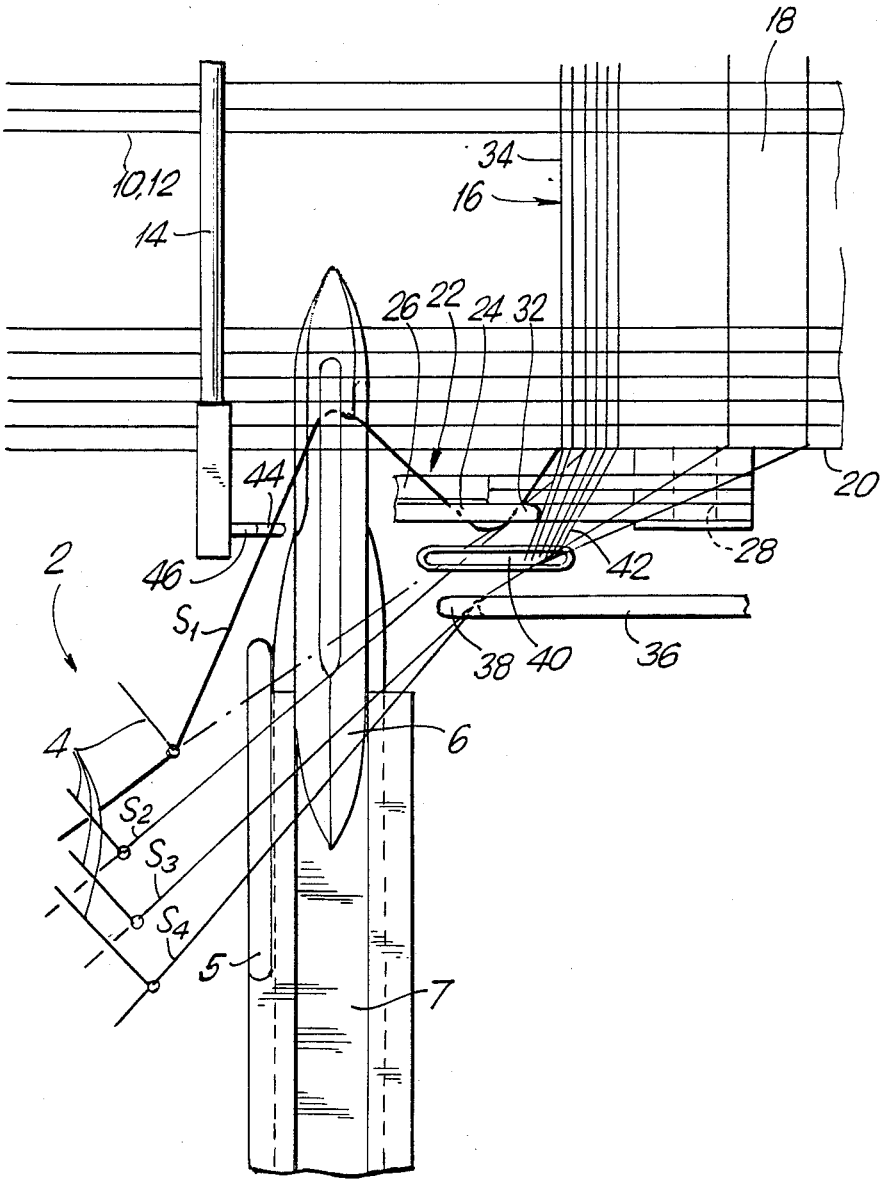
FIG. 1 is a plan view of a gripper loom on a filling thread insertion side of a fabric being formed.

FIGS. 1 to 4 show the parts of a gripper loom that are essential for the present invention. The remaining parts are known so that their explanation is unnecessary.

The figures show the insertion side of a gripper loom with a filler thread feeding device which, in the present case, is designed as a filling thread charger. This means that it incorporates different thread guides 4 for alternate presentation of different filling threads $S_1$, $S_2$, $S_3$, $S_4$, through a stabilizing element 5 into the entrainment region of a gripper 6 which is located in a gripper guide 7 and which is inserted into and again pulled out from the shed 8 by an insertion band which is not depicted here. The gripper 6 pulls the filling thread $S_1$, through shed 8 which is formed by warp threads 10 located at the top and warp threads 12 located at the bottom. A weaving reed 14 serves to beat-up the inserted filling thread at the fell 16 of a fabric 18. A pair of scissors 22 which opens toward the weaving reed 14 lies at the insertion side and externally of the fabric edge 20 in the region of the fell 16. The scissors comprise a lower scissor blade 26 which is rigidly installed in the machine and an upper scissor blade 24 driven in a manner not depicted here in detail, for instance, by means of known eccentric or cam drive gears, which scissor blade is pivotably supported on an axis 28. The lower scissor blade 26 is a stationary cutting blade supported at the axis 28. The blade 26 is not fixedly connected with the axis 28 so that its position can be adjusted by, for example, a screw. Furthermore, the upper scissor blade 24 is equipped at its free end with a restraining lug 30 pointing toward the other scissor blade 26, said restraining lug acting to retain a filling thread $S_1$, $S_2$, $S_3$, or $S_4$ selected to be inserted at the initiation of the inserting cycle. The upper scissor blade 24 has a catching hook 32 at its side extending in and parallel to the fabric movement direction so as to at least align and guide the filling thread $S_1$ or $S_2$ of a last inserted filling thread 34 with respect to the filling thread feeding device 2.

Furthermore, a guide member 36 installed rigidly in the machine is assigned to the edge 20 of the fabric and contains a fork-shaped guide 38 open toward the weaving reed 14 and which serves for aligning the filling threads $S_3$, $S_4$ still connected to the fabric web 18, which threads are located downstream in the direction of fabric movement. A suction nozzle 40 is arranged between the guide member 36 and the scissors 22 in the region of the scissors 22 in order to restrain the severed filling thread pieces 42 still protruding from the fabric web 18 from entering the region of the filling threads $S_1$, $S_2$, $S_3$, $S_4$ still connected with the filling thread feeding device in order to avoid entanglements. The reed 14 is equipped with a guide member 44 with a hook 46 in order to conduct the inserted filling thread $S_1$ over the upper scissor blade 24 during the looping process.

Figure 3:
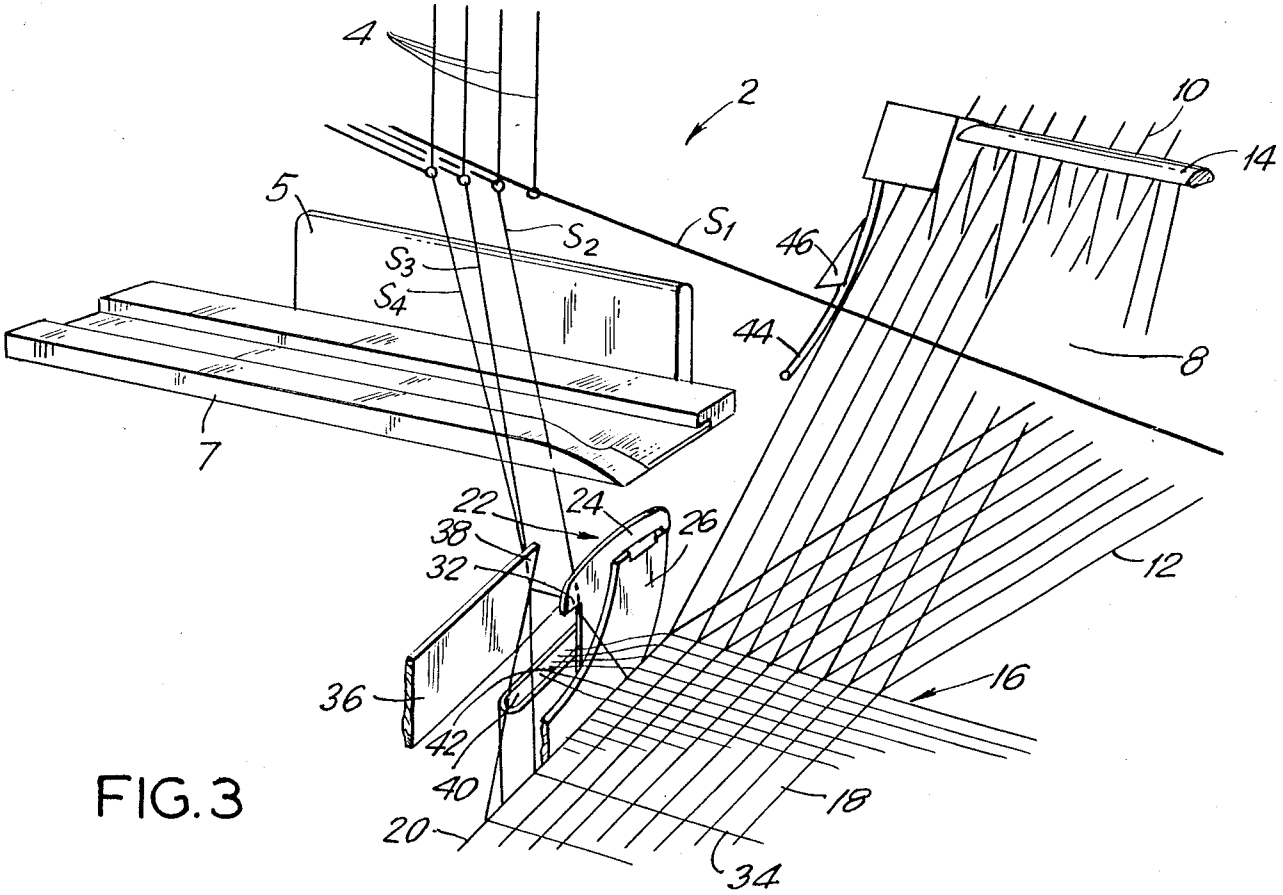
FIG. 3 is a perspective view of the gripper loom in FIG. 2, with completely pulled-in filling thread.
Figure 4:
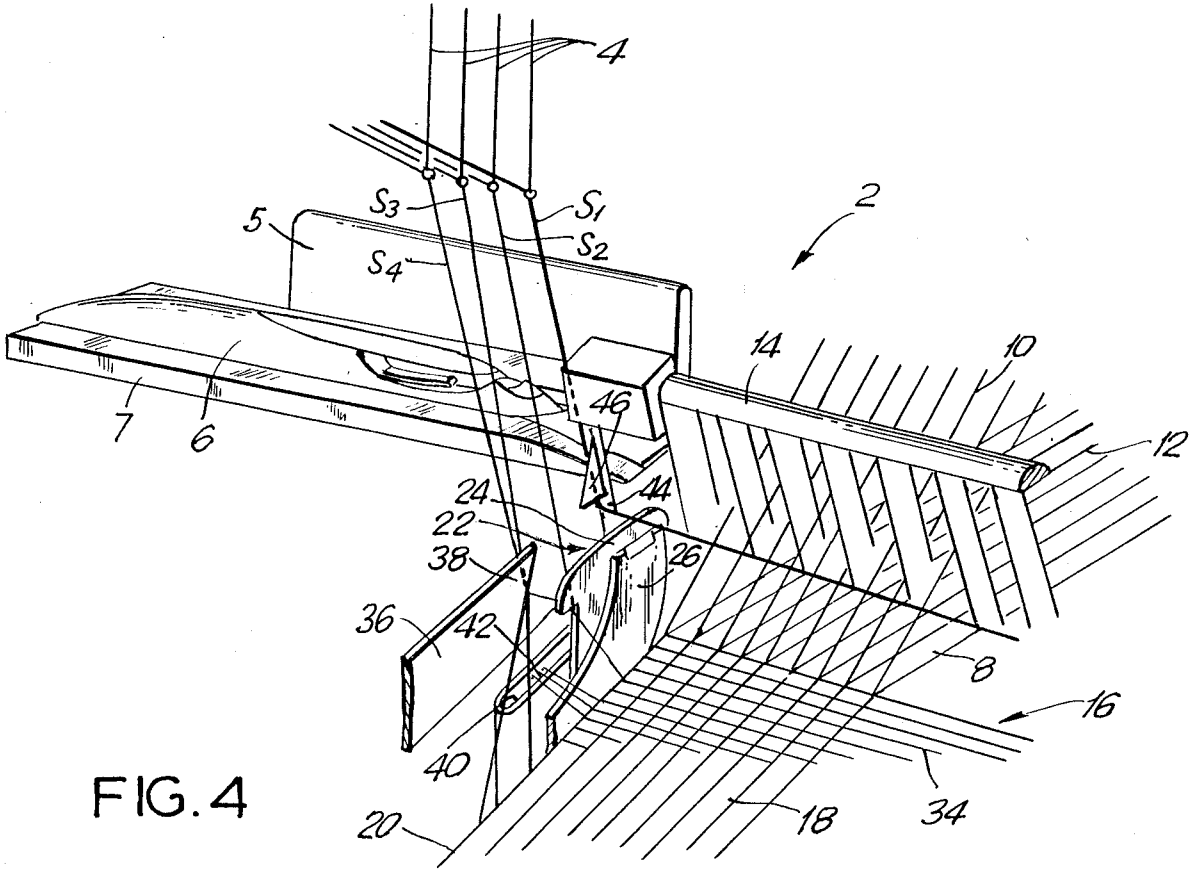
FIG. 4 is a perspective view of the gripper loom in FIG. 2 during the looping motion of the inserted filling thread.

The operational mode of the gripper loom will be described with particularity with the help of FIGS. 2–4.

Figure 2:
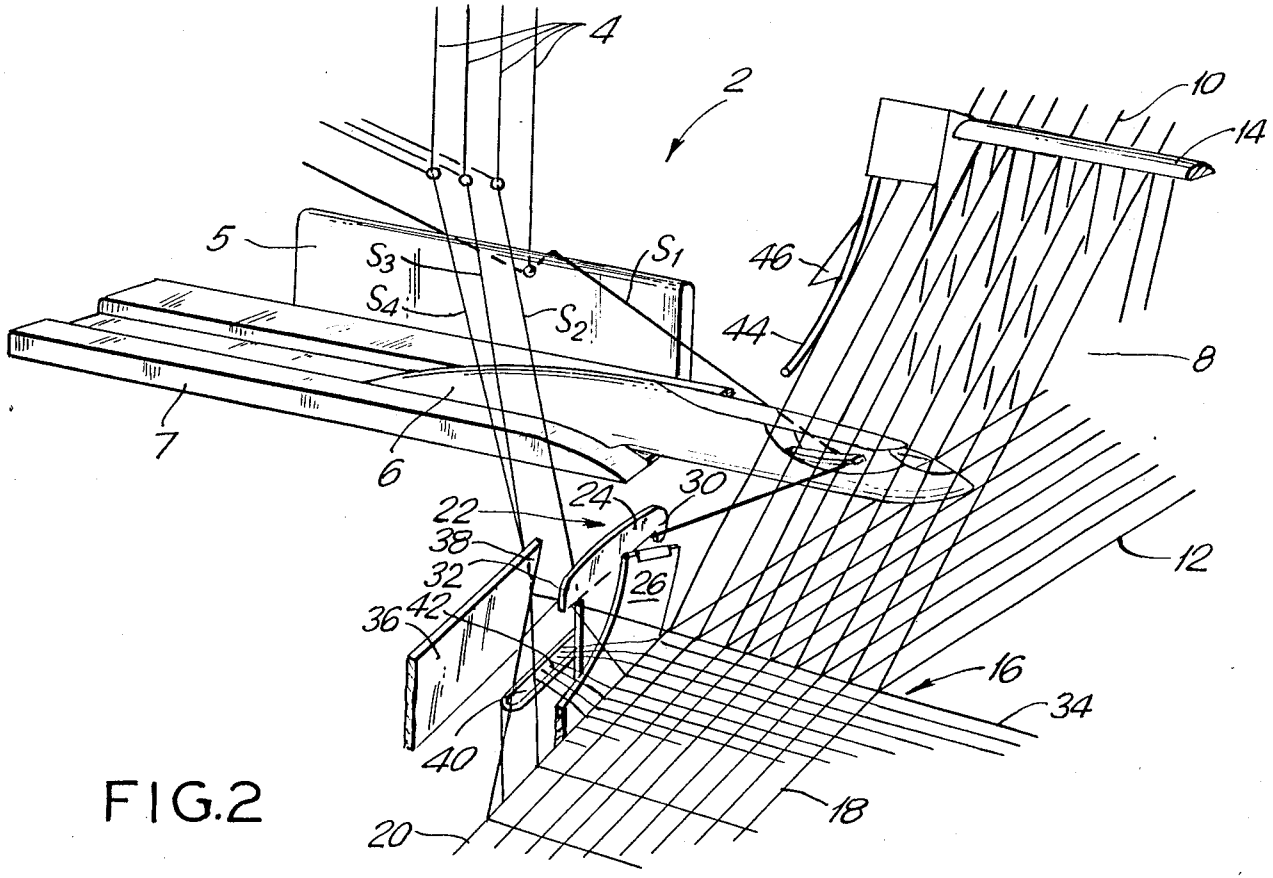
FIG. 2 is a perspective view of the gripper loom according to FIG. 1.

FIG. 2 shows a gripper loom in a functional phase when the filling thread feeding device 2 has conducted the filling thread $S_1$ to the entrainment region of the gripper 6 by means of the thread guide 4 and when the gripper has already grasped the filling thread $S_1$ and is on the way into the shed 8. The filling thread $S_1$ is connected to the fabric edge 20 on its side facing away from the filling thread feeding device 2 and is conducted around the catching hook 32 into the region of the open scissors 22. The filling thread $S_1$ is severed through actuation of the scissors 22, wherein the restraining lug 30 prevents the filling thread from sliding out of the scissors 22. Now the filling thread is completely drawn into the shed as FIG. 3 shows. As soon as the gripper 6 has released the filling thread $S_1$ and has again returned to its original position in accordance with FIG. 4, the reed 14 starts with the beat-up operation of the inserted filling thread $S_1$. At this stage, the scissors 2 have allready been closed and the reed 14 conducts the inserted filling thread $S_1$ above the upper scissor blade 24 behind the catching hook 32 by means of the thread guide member 44. The catching hook 32 aligns the filling thread $S_1$ with respect to the feeding device so that the thread can again be brought in an accurately defined manner by the thread guides 4 into the entrainment region of the gripper 6. If the filling thread $S_1$ is not required during several insertions of thread, then it travels with the fabric 18 and is transmitted by the catching hook 32 to the fork 38 of the guide member 36, as this operation is shown for the filling threads $S_3$ and $S_4$.

While a specific embodiment of the invention has been shown and described in detail to illustrate the application of the inventive principles, it will be understood that the invention may be embodied otherwise without departing from such principles.

What is claimed is:

1. A gripper loom, comprising:

a gripper having an entrainment region for receiving a filling thread and being movable into and out of a shed formed by warp threads so as to insert the filling thread into said shed a filling thread supply;

filling thread feeding means for placing at least one filling thread into the entrainment region of the gripper;

a reed movable between the warp threads in the shed so as to beat-up the inserted filling thread into the fell of the fabric; and scissors arranged at an insertion side of the shed adjacent the fabric edge and the fell, said scissors being openable toward said reed and operable to receive and separate a previously inserted filling thread during renewed insertion of that thread into a shed, said scissors being closed during the beat-up movement of the reed so that a portion of the just inserted filling thread extending from the fabric edge and connected to the supply is moved above said scissors and beneath a catching hook located on the side of said scissors away from said reed 2. A gripper loom according to claim 1, and further comprising a guide member rigidly connected near the fabric edge so as to align the portions of the inserted filling threads which extend from the fabric edge with respect to said filling thread feed means, said guide member having a fork-shaped end open toward said weaving reed.

3. A gripper loom according to claim 2, and further comprising a suction nozzle directed toward said filling threads and arranged in a region of said scissors and said catching hook, and beneath said portions of the filling thread extending from the fabric edge.

4. A gripper loom according to claim 3, wherein said suction nozzle is arranged between said scissors and said guide member.

5. a gripper loom according to claim 1, wherein said catching hook is arranged on a lower blade of said scissors.

6. A gripper loom according to claim 1, and further comprising a guide member arranged near said reed so as to conduct the inserted filling thread above and past an upper blade of said scissors during beat-up.

7. A gripper loom according to claim 1, wherein said scissors comprise a pair of blades including an upper blade having a fee end with a restraining lug pointed toward a lower blade so as to retain a laid-in filling thread.

8. A gripper loom according to claim 7, wherein the lower blade is driven.

9. A gripper loom according to claim 7, wherein the upper blade is driven.

10. A gripper loom according to claim 7, wherein both the lower and upper scissor blades are driven.

11. A gripper loom according to claim 1, wherein said filling thread feeding means includes a filling thread changer for presenting selected filling threads to said gripper.

12. A gripper loom according to claim 1, wherein said catching hook is arranged on an upper blade of said scissors.

* * * * *